US007945376B2

(12) United States Patent
Geyer et al.

(10) Patent No.: US 7,945,376 B2
(45) Date of Patent: May 17, 2011

(54) ENGINE AND METHOD OF MAINTAINING ENGINE EXHAUST TEMPERATURE

(75) Inventors: Stephen Geyer, State Line, PA (US); Robert Gorman, Chambersburg, PA (US); Gregory J. Birky, Boonsboro, MD (US)

(73) Assignee: Mack Trucks, Inc., Greensboro, NC (US)

( * ) Notice: Subject to any disclaimer, the term of this patent is extended or adjusted under 35 U.S.C. 154(b) by 699 days.

(21) Appl. No.: 11/917,911

(22) PCT Filed: Jul. 11, 2005

(86) PCT No.: PCT/US2005/024197

§ 371 (c)(1),
(2), (4) Date: Dec. 18, 2007

(87) PCT Pub. No.: WO2007/008196

PCT Pub. Date: Jan. 18, 2007

(65) Prior Publication Data

US 2010/0211292 A1 Aug. 19, 2010

(51) Int. Cl.
*F02D 41/00* (2006.01)
*F02B 47/08* (2006.01)

(52) U.S. Cl. ..... 701/108; 123/568.21

(58) Field of Classification Search ..... 701/108, 701/109, 102, 115; 123/568.19, 568.11, 123/568.12, 568.21; 60/278, 279, 280, 605.2
See application file for complete search history.

(56) References Cited

U.S. PATENT DOCUMENTS

| | | | | |
|---|---|---|---|---|
| 4,231,338 | A * | 11/1980 | Sugasawa et al. | 60/278 |
| 4,969,104 | A * | 11/1990 | Suzuki et al. | 701/108 |
| 5,806,308 | A | 9/1998 | Khair et al. | |
| 6,009,709 | A | 1/2000 | Bailey | |
| 6,543,230 | B1 | 4/2003 | Schmid | |
| 6,789,531 | B1 | 9/2004 | Remmels | |
| 7,043,914 | B2 * | 5/2006 | Ishikawa | 60/605.2 |
| 2005/0000497 | A1 | 1/2005 | Nakai et al. | |
| 2009/0126706 | A1 * | 5/2009 | Shimoda | 123/568.12 |

FOREIGN PATENT DOCUMENTS

| | | | |
|---|---|---|---|
| JP | 58-27032 | A * | 2/1983 |
| JP | 3-138444 | A * | 6/1991 |
| JP | 11-229905 | A * | 8/1999 |
| JP | 2005023900 | | 1/2005 |

OTHER PUBLICATIONS

International Search Report for corresponding International Application PCT/US2005/024197.

* cited by examiner

*Primary Examiner* — Hieu T Vo
(74) *Attorney, Agent, or Firm* — WRB-IP LLP

(57) ABSTRACT

In a method of maintaining temperature of engine exhaust gas from cylinders of a multi-cylinder engine (23) with a desired range, exhaust gas from a first group of cylinders (25) including at least one cylinder is routed to at least one of an EGR system (53) and an exhaust system (41). Exhaust gas from a second group of cylinders (27) including at least one of the cylinders is routed to the exhaust system (41). Routing of the exhaust gas from the first group of cylinders between the EGR system and the exhaust system is controlled to maintain a temperature of engine exhaust gas within a desired range. An engine (23), a control system (69), and a controller (71), as well as an exhaust gas mixture, are also disclosed.

30 Claims, 1 Drawing Sheet

ENGINE AND METHOD OF MAINTAINING ENGINE EXHAUST TEMPERATURE

The present invention relates to engines and, more particularly, to engines including exhaust gas recirculation (EGR) systems.

Many modern engines use EGR to decrease harmful engine emissions. When combustion temperatures exceed approximately 2500° F. (1372° C.), nitrogen in air combines with oxygen to produce nitrogen oxides (NOx). By introducing recirculated exhaust gas to the intake air, oxygen ($O_2$) content of the intake air is reduced. Consequently, the combustion temperature can be reduced and production of NOx can be reduced.

Presently, most engines that include EGR systems recirculate from 0-25% EGR gas. As engine emission control requirements become more stringent, it is anticipated that higher percentages of EGR gas will be used. EGR percentages around 35% are expected for 2007 and percentages around 45-50% are expected for 2010. It is desirable to provide additional methods and equipment for using EGR technology.

According to an aspect of the present invention, a method of maintaining temperature of engine exhaust gas from cylinders of a multi-cylinder engine within a desired range is provided. According to the method, exhaust gas from a first group of cylinders comprising at least one cylinder is routed to at least one of an EGR system and an exhaust system. Exhaust gas from a second group of cylinders comprising at least one cylinder is routed to the exhaust system. Routing of the exhaust gas is from the first group of cylinders between the EGR system and the exhaust system to maintain a temperature of engine exhaust gas within a desired range.

According to another aspect of the present invention, an internal combustion engine comprises a plurality of cylinders comprising a first group of cylinders comprising at least one cylinder and a second group of cylinders comprising at least one cylinder. The engine comprises an exhaust system comprising a turbine of a turbocharger, an exhaust manifold arranged to route gas from the second group of cylinders to the exhaust system upstream of the turbine, and an EGR system adapted to regulate flow of gas between the first group of cylinders and an intake to the plurality of cylinders and the exhaust system downstream of the turbine.

According to another aspect of the present invention, an exhaust gas mixture in an exhaust system comprising an exhaust gas turbocharger is provided. The exhaust gas mixture comprises exhaust gas routed from a first group of cylinders comprising at least one cylinder to the exhaust system downstream of the turbocharger, and exhaust gas routed from a second group of cylinders comprising at least one cylinder to the exhaust system upstream of the turbocharger. The exhaust gas from the first group of cylinders and the exhaust gas from the second group of cylinders form the mixture in the exhaust system downstream of the turbocharger.

According to another aspect of the present invention, a control system for an engine is provided. The engine comprises a first group of cylinders comprising at least one cylinder adapted to connect to an EGR system and a second group of cylinders comprising at least one cylinder connected to the exhaust system. The control system comprises a temperature sensor in the exhaust system, a valve disposed in a line between the EGR system and the exhaust system, and a controller for controlling opening and closing the valve at least partially in response to a signal from the temperature sensor.

According to another aspect of the present invention, a controller for an engine control system is provided. The controller is programmed to send a signal to open and close a valve in a line between an EGR system and an exhaust system in response to a signal from a temperature sensor in the exhaust system.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
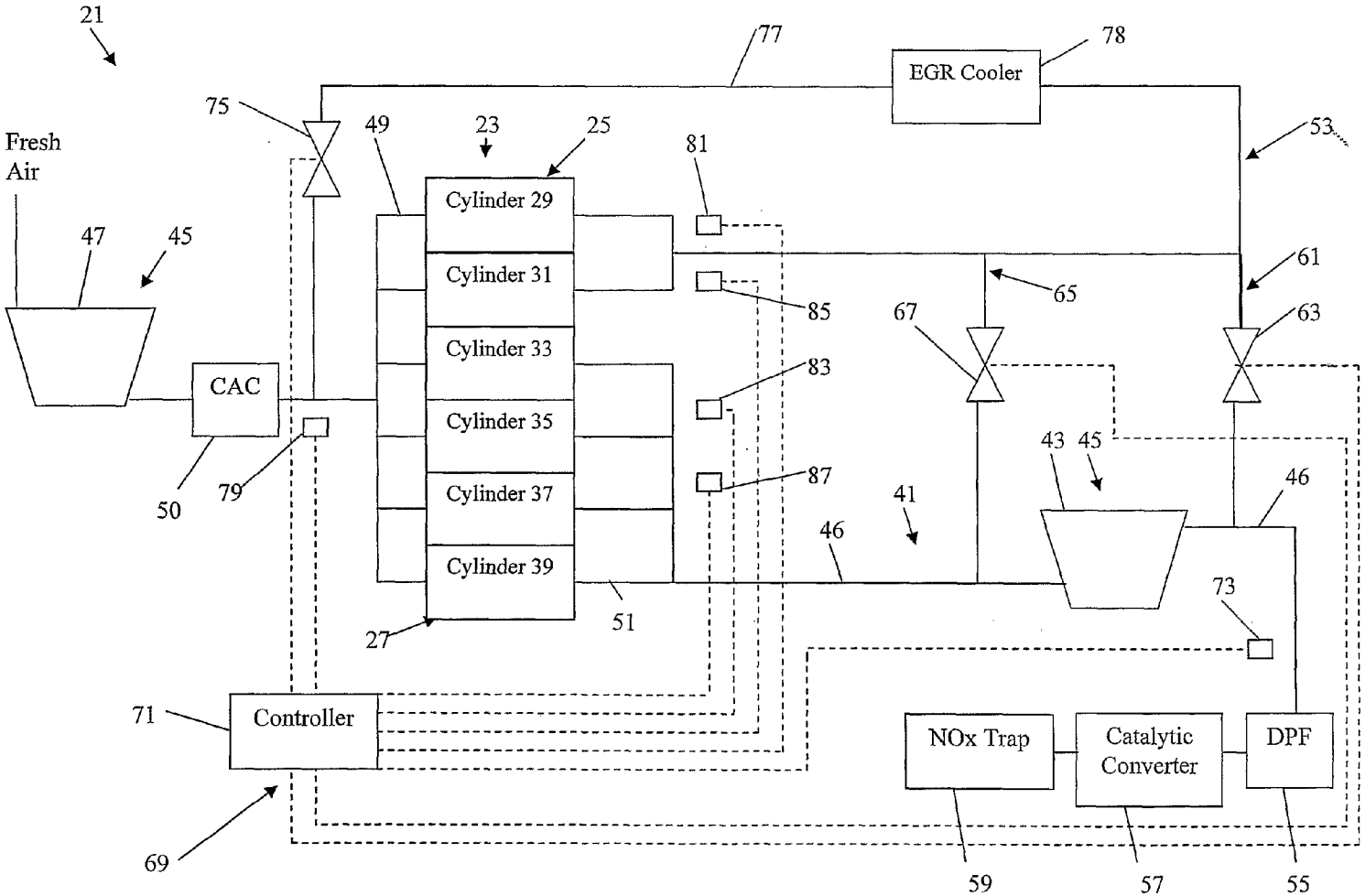
FIG. 1 is a schematic view of an engine including an EGR system according to an embodiment of the present invention.

An internal combustion engine 21 according to an embodiment of the present invention is shown in FIG. 1. The engine 21 comprises a plurality of cylinders 23 comprising a first group 25 of cylinders and a second group 27 of cylinders. The first group 25 of cylinders and the second group 27 of cylinders each comprises at least one cylinder. In the embodiment illustrated in FIG. 1, the first group 25 of cylinders comprises two cylinders 29 and 31 and the second group 27 of cylinders comprises four cylinders 33, 35, 37, 39.

The engine 21 typically comprises an exhaust system 41 comprising a turbine 43 of a turbocharger 45 that is typically disposed between sections 46 of an exhaust pipe, the exhaust pipe including a tailpipe. The turbocharger 45 is typically an exhaust gas turbocharger that includes a compressor 47 used to charge incoming air headed for the engine's intake manifold 49. A charged air cooler (CAC) 50 may be disposed downstream of the compressor 47. The engine 21 typically comprises an exhaust manifold 51 arranged to route gas from the second group 27 of cylinders to the exhaust system 41 upstream of the turbine 43. Thus, exhaust from the second group 27 of cylinders can be used to drive the turbine 43.

The engine 21 further comprises an EGR system 53. The EGR system 53 may be adapted to regulate flow of gas between the first group 25 of cylinders and an intake to the cylinders 23 such as the intake manifold 49 or, more typically, a point upstream of the intake manifold. In this way, the amount of EGR gas in the intake can be adjusted. Flow may be regulated between 0-100% of exhaust from the first group 25 of cylinders.

The EGR system 53 may also be adapted to regulate flow of gas between the first group 25 of cylinders and the exhaust system 41 upstream of the turbine 43. When introduced upstream of the turbine 43, exhaust gas from the first group 25 of cylinders can be used to help drive the turbine. Flow may be regulated between 0-100% of exhaust from the first group 25 of cylinders.

The EGR system 53 may also be adapted to regulate flow of gas between the first group 25 of cylinders and the exhaust system 41 downstream of the turbine 43. Flow may be regulated between 0-100% of exhaust from the first group 25 of cylinders. Downstream of the turbine 43, the exhaust system 41 can also include other components, such as a diesel particulate filter (DPF) 55, a catalytic converter 57, and/or a nitrogen oxide trap (NOx trap) 59. The foregoing list and sequence of aftertreatment components is meant to be illustrative, not limiting. There may, for example, be multiple catalytic converters disposed before or after other components, and there may be more and other types of aftertreatment components, such as selective catalytic reduction (SCR) components, as well.

Temperature is typically important to the proper operation of components in the exhaust system 41. For example, at low temperatures, a catalytic converter 57 will not function well and at high temperatures it may be damaged. Components such as the DPF 55 and NOx trap 59 are typically periodically regenerated, usually by a process wherein the temperatures of the DPF or NOx trap are raised. To regenerate a DPF, for example, it is common to introduce fuel upstream of the DPF. The fuel burns and raises the temperature of the exhaust gas, usually to somewhere between 500-700° C., which burns off the trapped particulates. Regeneration of a NOx trap occurs in a similar manner. In either case, if the temperatures are not raised high enough, proper regeneration does not occur and, if the temperatures are raised too high, the components can be damaged such as through deterioration of catalysts in a DPF.

Where and whether exhaust gas from the first group 25 of cylinders is introduced into the exhaust stream, e.g., upstream or downstream of the turbine 43, or both, or not at all, can affect the temperature of the exhaust stream. Thus, according to one aspect of the present invention, the EGR system 53 is connected to the exhaust system 41 by a line 61 connected downstream of the turbine 43. A valve 63 can be placed in the line 61 to regulate flow between the EGR system 53 and the exhaust system 41. Typically, introduction of exhaust gas from the first group 25 of cylinders from the EGR system 53 to the exhaust system 41 downstream of the turbine 43 will raise the temperature of the exhaust gas in the exhaust system. By appropriately adjusting the temperature of the exhaust gas in the exhaust system 41, proper operation temperatures can be maintained, and regeneration temperatures can be attained without the need for, e.g., introducing fuel to raise temperatures to a level sufficient to burn off particulates and the like, or without the need for introducing as much fuel as in conventional systems.

While it is presently contemplated that exhaust gas from the first group 25 of cylinders introduced into the exhaust system 41 downstream of the turbine 43 will generally be used to raise the temperature of the exhaust gas in the exhaust system, it is possible that, in some circumstances, the exhaust gas from the first group of cylinders will lower the temperature of the exhaust gas in the exhaust system. For example, operating conditions of the first group 25 of cylinders may be different than those for the second group 27 of cylinders such that the temperature of the exhaust gas from the first group of cylinders is lower than the temperature of the exhaust gas from the second group of cylinders, even after the exhaust gas from the second group of cylinders passes through the turbine 43.

According to another aspect of the present invention, the EGR system 53 is connected to the exhaust system 41 by a line 65 connected upstream of the turbine 43. A valve 67 can be placed in the line 65 to regulate flow between the EGR system 53 and the exhaust system 41. The exhaust gas from the first group 25 of cylinders can, inter alia, assist in turning the turbine 43 which may be useful when, for example, it is desired to increase the intake pressure. Typically, the EGR system 53 will be adapted to be connected to the exhaust system 41 by both the line 61 and the line 65, however, embodiments of the present invention may include just the line 61 downstream of the turbine 43 and other embodiments may include just the line 65 upstream of the turbine.

In addition to, or instead of, adjusting temperature and other characteristics of the exhaust stream in the exhaust system 41 by introducing exhaust gas from the first group 25 of cylinders in the exhaust system upstream and/or downstream of the turbine, temperature and other characteristics of the exhaust stream in the exhaust system can be affected by causing the exhaust gas from the first group 25 of cylinders to have different characteristics, such as temperature and pressure, than the exhaust gas from the second group 27 of cylinders. For example, different quantities of fuel can be provided in the first group 25 of cylinders than in the second group 27. Also, instead of using a single intake manifold 49 for all of the cylinders 23 so that all of the cylinders receive intake air having substantially the same intake pressure and percentage of EGR gas, the first group of cylinders 25 can have a different intake (not shown) than the second group of cylinders 27, can be operated at a different intake pressure, and can receive a different percentage of EGR gas.

The turbocharger 45 can be a variable geometry turbocharger (VGT) or a conventional fixed geometry turbocharger. A VGT is often useful for regulating exhaust manifold and intake boost pressures in engines with EGR systems. However, the engine 21 according to the present invention permits substantial control over the characteristics of the exhaust gas from the first group 25 of cylinders. The first group 25 of cylinders can be operated under certain conditions to obtain desired EGR gas characteristics, while the second group 27 of cylinders can be operated under different conditions to obtain desired power.

This ability to control the exhaust from the first group 25 of cylinders can facilitate the use of fixed geometry turbochargers that are less expensive than the VGT. It also facilitates the use of smaller lines for the EGR system, and smaller EGR cooling equipment. For example, because the first group 25 of cylinders is "dedicated" to use for EGR, these dedicated cylinders can be operated at different conditions than the second group 27 of cylinders which are operated at whatever conditions are necessary to generate desired power, regardless of any desired characteristics of their exhaust gas. By controlling the first group 25 of cylinders so that the exhaust gas from those cylinders has a lower $O_2$ level than the exhaust gas from the second group 27 of cylinders, a smaller volume of EGR gas can be used to lower the concentration of $O_2$ at the intake manifold 49 than in conventional systems where EGR gas is drawn off of the exhaust from all of the cylinders. Levels of $O_2$ in an exhaust stream can be different in any suitable sense, such as different levels of $O_2$ by volume.

The engine 21 will ordinarily include a control system 69. The control system 69 will typically include a controller 71, such as a computer. The control system 69 can also include one or more sensors, such as a temperature sensor 73 in the exhaust system 41. The EGR system 53 typically includes an EGR valve 75 in the EGR line 77 between the exhaust manifold for the first group 25 of cylinders and the intake manifold 49. The EGR line 77 typically joins the intake to the cylinders 23 downstream of the compressor 47 and the CAC 50, if provided. An EGR cooler 78 is usually disposed in the EGR line 77. The control system can also comprise a valve, such as one or more of the valves 63 and 67, disposed in a line, such as one or more of the lines 61 and 65, between the EGR system 53 and the exhaust system 41. The controller 71 can be programmed to control opening and closing at least one of the valve 63, 67, and/or 75 at least partially in response to a signal from the temperature sensor 73. In addition to the temperature sensor 73 in the exhaust line, there may be other sensors, such as a pressure sensor 79 at the intake manifold, temperature sensors 81 and 83 and/or pressure sensors 85 and 87 at exhausts of the first and second groups of cylinders, respectively, and the like. The controller 71 can receive signals from some or all of these sensors to control opening and closing of some or all of the valves 63, 67, and/or 75 or other operational parameters for the engine or groups of cylinders.

In one illustrative aspect of the present invention, during, for example, a regeneration cycle for aftertreatment components such as a DPF or a NOx trap, the temperature sensor 73 can send a signal to the controller 71 indicating that the temperature in the exhaust stream is below a desired temperature for regeneration. In response to this signal, the controller 71 can send a signal to the valve 63 to open so that hot exhaust gas from the first group 25 of cylinders bypasses the turbine 43 and mixes with the exhaust gas from the second group 27 of cylinders that has passed through the turbine. The temperature sensor 73 can continue to send signals indicating that the temperature is below a desired temperature, and the controller 71 can continue to send responsive signals to keep the valve 63 open, until the desired temperature is reached. At that point, the temperature sensor 73 can send a signal to the controller 71 indicating that the desired temperature has been reached, and the controller can send a signal to close the valve 63.

In another aspect of the invention, the temperature sensor 73 can send a signal to the controller 71 and the controller can send a responsive signal to open or close the valve 67 so that exhaust gas from the first group 25 of cylinders does or does not mix with exhaust gas from the second group 27 of cylinder upstream of the turbine 43. This valve 67 may be controlled in conjunction with control of the valve 63 to achieve a desired temperature or pressure or other condition in the exhaust system or the EGR system. Likewise, the EGR valve 75 can be operated by a signal from the controller 71 in response to a signal from the temperature sensor 73.

In another aspect of the invention, the intake manifold 49 may be disposed downstream of the compressor 47 of the turbocharger 45 and a pressure sensor 79 may be disposed proximate the intake manifold. The controller 71 can control opening and closing of at least one of the valves 63, 67, and 75 at least partially in response to a signal from the pressure sensor 79. For example, as the pressure sensor 79 senses rising pressure, the EGR valve 75 may be opened further to maintain or adjust the EGR level at the intake manifold 49.

In yet another aspect of the invention, the controller 71 can receive a variety of signals, such as signals from the temperature and pressure sensors, and can send signals to control other operating conditions in the engine. For example, the first group 25 of cylinders can be controlled to produce desired exhaust characteristics, e.g., minimal $O_2$ in the exhaust, while the second group 27 of cylinders can be controlled to produce desired power characteristics, e.g., high power densities.

In a method according to the present invention, the temperature of engine 21 exhaust gas is maintained within a desired range, such as a range optimal for regenerating DPF 55 or NOx trap 59 equipment, or a range optimal for operating aftertreatment components such as the DPF or NOx trap, or a catalytic converter 57. In the method, exhaust gas from the first group 25 of cylinders is routed to at least one of an EGR system 53 and an exhaust system 41. Exhaust gas from the second group 27 of cylinders is routed to the exhaust system 31. The routing of the exhaust gas from the first group 25 of cylinders between the EGR system 53 and the exhaust system 41 is controlled, such as by the controller 71, to maintain a temperature of engine exhaust gas within a desired range.

The first group 25 of cylinders can be operated separately from the second group 27 of cylinders. Manipulation of the operating conditions of the first and second groups 25 and 27 of cylinders can be used to maintain the temperature of the engine exhaust gas within the desired range. For example, returning more EGR gas to the intake of the cylinders will ordinarily lower the temperature of the exhaust gas. Other factors can be manipulated as well, such as fuel delivery. Delivering different amounts of fuel to cylinders of the first group 25 of cylinders and cylinders of the second group 27 of cylinders can also affect temperature. The first group 25 of cylinders can be operated at a different power density than the second group 27 of cylinders, such as by supplying different amounts of fuel to the cylinder groups. The power density of the first group 25 of cylinders may, for example, be operated so as to optimize exhaust characteristics, such as minimal $O_2$, and may therefore be lower than the power density of the second group 27 of cylinders, which may be operated so as to optimize power characteristics.

The engine exhaust temperature can also be managed, at least in part, by regulating flow of EGR gas prior to introduction into the intake 49, such as by regulating pressure of EGR gas by adjusting the EGR valve 75. As more EGR gas is present in the mixture of fresh air and EGR gas at the intake manifold 49, the combustion temperature will ordinarily be lower.

In a six-cylinder engine such as is illustrated, it is advantageous for the first group 25 of cylinders including the two cylinders 29 and 31 to be the first and the sixth cylinders of the six cylinders. This is because the first and sixth cylinders are typically timed the same. Taking power off of those cylinders is typically less apt to excessively offset the balance of the engine. It will be appreciated, however, that the present invention has application in engines other than those having six cylinders.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. An internal combustion engine, comprising:

a plurality of cylinders comprising a first group of cylinders comprising at least one cylinder and a second group of cylinders comprising at least one cylinder;

an exhaust system comprising a turbine of a turbocharger;

an exhaust manifold arranged to route gas from the second group of cylinders to the exhaust system upstream of the turbine; and an EGR system adapted to regulate flow of gas between the first group of cylinders and an intake to the plurality of cylinders and the exhaust system downstream of the turbine to maintain a temperature of engine exhaust gas within a desired range.

2. The internal combustion engine as set forth in claim 1, wherein the EGR system is adapted to regulate flow of gas between the first group of cylinders and the exhaust system upstream of the turbine.

3. The internal combustion engine as set forth in claim 1, comprising at least one aftertreatment component downstream of the turbine.

4. A control system for an engine, the engine comprising a first group of at least one cylinder adapted to connect to an EGR system and a second group of at least one cylinder connected to the exhaust system, the control system comprising:

a temperature sensor in the exhaust system;

a valve disposed in a line between an EGR line of the EGR system and the exhaust system; and a controller for controlling opening and closing the valve at least partially in response to a signal from the temperature sensor, comprising a pressure sensor upstream of the exhaust system, the controller controlling opening and closing of the valve at least partially in response to a signal from the pressure sensor.

5. The control system as set forth in claim 4, wherein the exhaust system comprises a turbocharger turbine, and the line connects to the exhaust system downstream of the turbine.

6. The control system as set forth in claim 5, comprising a second valve in a second line between the EGR line and the exhaust system, the controller controlling opening and closing of the second valve at least partially in response to a signal from the temperature sensor.

7. The control system as set forth in claim 6, comprising a third valve in the EGR line, the controller controlling opening and closing the third valve at least partially in response to a signal from the temperature sensor.

8. The control system as set forth in claim 7, comprising an intake downstream of a compressor of the turbocharger and a pressure sensor proximate the intake, the controller controlling opening and closing of at least one of the first, second, and third valves at least partially in response to a signal from the pressure sensor.

9. The control system as set forth in claim 5, comprising an intake downstream of a compressor of the turbocharger and a pressure sensor proximate the intake, the controller controlling opening and closing of the valve at least partially in response to a signal from the pressure sensor.

10. The control system as set forth in claim 4, comprising a second valve in a second line between the EGR line and the exhaust system, the controller controlling opening and closing of the second valve at least partially in response to a signal from the temperature sensor.

11. The control system as set forth in claim 4, comprising a second valve in the EGR system, the controller controlling opening and closing the second valve at least partially in response to a signal from the temperature sensor.

12. An engine comprising the control system as set forth in claim 4.

13. The engine as set forth in claim 12, comprising at least one aftertreatment component in the exhaust system downstream of the line.

14. An exhaust gas mixture in an exhaust system comprising an exhaust gas turbocharger, comprising:

exhaust gas routed from a first group of cylinders comprising at least one cylinder to the exhaust system downstream of the turbocharger; and exhaust gas routed from a second group of cylinders comprising at least one cylinder to the exhaust system upstream of the turbocharger, wherein the exhaust gas from the first group of cylinders and the exhaust gas from the second group of cylinder form the mixture in the exhaust system downstream of the turbocharger and are mixed in quantities determined as a function of temperature of the exhaust gas from the first group of cylinders and temperature of the exhaust gas from the second group of cylinders to maintain temperature of the mixture within a desired range.

15. The exhaust gas mixture as set forth in claim 14, comprising exhaust gas routed from the first group of cylinders to the exhaust system upstream of the turbocharger.

16. The exhaust gas mixture as set forth in claim 14, wherein exhaust gas routed from the first group of cylinders has a lower $O_2$ content than exhaust gas routed from the second group of cylinders.

17. The exhaust gas mixture as set forth in claim 14, wherein exhaust gas routed from the first group of cylinders has a different temperature than exhaust gas routed from the second group of cylinders.

18. The exhaust gas mixture as set forth in claim 14, wherein exhaust gas routed from the first group of cylinders has a higher temperature than exhaust gas routed from the second group of cylinders.

19. A method of maintaining temperature of engine exhaust gas from cylinders of a multi-cylinder engine within a desired range, comprising:

routing exhaust gas from a first group of cylinders comprising at least one cylinder to at least one of an EGR system and an exhaust system;

routing exhaust gas from a second group of cylinders comprising at least one cylinder to the exhaust system; and controlling routing of the exhaust gas from the first group of cylinders between the EGR system and the exhaust system to maintain a temperature of engine exhaust gas within a desired range.

20. The method of maintaining temperature of engine exhaust gas as set forth in claim 19, comprising operating the first group of cylinders under different conditions than the second group of cylinders.

21. The method of maintaining temperature of engine exhaust gas as set forth in claim 20, comprising operating the first group of cylinders at a different power density than the second group of cylinders.

22. The method of maintaining temperature of engine exhaust gas as set forth in claim 19, comprising operating the first group of cylinders at a different power density than the second group of cylinders.

23. The method of maintaining temperature of engine exhaust gas as set forth in claim 19, comprising regulating pressure of EGR gas prior to introduction into an intake of the cylinders.

24. The method of maintaining temperature of engine exhaust gas as set forth in claim 23, comprising regulating pressure of EGR gas prior to introduction into the intake by adjusting an EGR valve.

25. The method of maintaining temperature of engine exhaust gas as set forth in claim 19, comprising regulating temperature of EGR gas prior to introduction into an intake of the cylinders.

26. The method of maintaining temperature of engine exhaust gas as set forth in claim 19, comprising regulating flow of EGR gas into an intake of the cylinders.

27. The method of maintaining temperature of engine exhaust gas as set forth in claim 19, wherein the exhaust system comprises a turbocharger turbine, the method comprising routing exhaust gas of the second group of cylinders to the turbine.

28. The method of maintaining temperature of engine exhaust as set forth in claim 27, comprising routing at least some exhaust gas of the first group of cylinders to the exhaust system downstream of the turbine.

29. The method of maintaining temperature of engine exhaust as set forth in claim 28, comprising routing at least some exhaust gas of the first group of cylinders to the exhaust system upstream of the turbine.

30. The method of maintaining temperature of engine exhaust as set forth in claim 27, comprising routing at least some exhaust gas of the first group of cylinders to the exhaust system upstream of the turbine.

* * * * *